US006590472B2

(12) United States Patent
Borodulin et al.

(10) Patent No.: US 6,590,472 B2
(45) Date of Patent: Jul. 8, 2003

(54) SURFACE MOUNTED BROADSIDE DIRECTIONAL COUPLER

(75) Inventors: Dmitriy Borodulin, Mason, OH (US); Timothy Dittmer, Mason, OH (US); George Cabrera, Mason, OH (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/932,390

(22) Filed: Aug. 17, 2001

(65) Prior Publication Data

US 2003/0034856 A1 Feb. 20, 2003

(51) Int. Cl.[7] ..... H01P 5/18
(52) U.S. Cl. ..... 333/116; 333/115
(58) Field of Search ..... 333/116, 115; H01P 5/18

(56) References Cited

U.S. PATENT DOCUMENTS 4,823,097 A * 4/1989 Konishi et al. ..... 333/116
5,539,362 A 7/1996 Culling ..... 333/116

OTHER PUBLICATIONS

Konishi et al., "A Directional Coupler of a Vertically Installed Planar Circuit Structure," IEEE Transactions on Microwave Theory and Techniques, vol. 36, No. 6, Jun. 1988. pp. 1057–1063.*

* cited by examiner

*Primary Examiner*—Justin P. Bettendorf
(74) *Attorney, Agent, or Firm*—Tarolli, Sundheim, Covell & Tummino L.L.P.

(57) ABSTRACT

A directional coupler comprises a coupler circuit board which is mounted substantially perpendicular to the surface of a parent circuit board. First and second upper traces are disposed on the opposing surfaces of the coupler circuit board. The coupling between the upper electrically conductive traces determines the odd mode impedance of the coupler. First and second lower traces are also disposed on opposing surfaces and connected to ground. The upper and lower traces are arranged such that the even mode of the impedance is determined by the coupling between the first upper trace and the second lower trace and the coupling between the second upper trace and the first lower trace.

13 Claims, 5 Drawing Sheets

SURFACE MOUNTED BROADSIDE DIRECTIONAL COUPLER

BACKGROUND OF THE INVENTION

1. Technical Field

The present invention relates generally to a TEM-mode quarter wavelength directional coupler, and specifically to such a coupler having coupling line elements, disposed on opposing sides of a circuit board, which determine the even and odd mode impedances of the coupler independent of the parent circuit board on which the coupler is mounted and the material from which the circuit board is composed.

2. Description of the Prior Art

A directional coupler is a four port device used as a power divider or combiner for electromagnetic wave transmissions. The four ports are designated Port 1, Port 2, Port 3, and Port 4. When a signal is input to Port 1, it is coupled into Ports 2 and 3 but not into Port 4. A signal input to Port 4 is similarly coupled into Ports 2 and 4 but not into Port 1. Because there is no coupling between Ports 1 and 4, these ports are known as uncoupled or isolated ports relative to each other. Signals may also be input, or result from reflections, in Ports 2 and 3. A signal input to Port 2 is coupled to Ports 1 and 4, but not to Port 3, while a signal input to Port 3 is coupled to Ports 1 and 4, but not to Port 2. Thus, Ports 2 and 3 are isolated ports relative to one another.

A directional coupler is disclosed in U.S. Pat. No. 5,539,362 to Michael J. Culling, which is assigned to the same assignee as the application herein. The coupler comprises a coupler dielectric board, which stands erect on the upper surface of a parent circuit board. Upper and lower electrically conductive elements with square interdigital teeth are disposed on each surface of the coupler dielectric board. Lead lines are disposed on the upper surface of the parent circuit board and are connected to both ends of the upper conductive elements on each side. The lower conductive elements are connected to ground.

The odd mode impedance in the directional coupler is a function of the coupling between the two upper conductive elements. The majority of electric field associated with the odd mode impedance passes through the coupler dielectric board. The even mode impedance is a function of the coupling between the upper and lower conductive elements on the same side of the coupler dielectric board. Accordingly, a significant portion of the electric field associated with the even mode impedance passes through the air surrounding the board.

The different permittivity values of the dielectric board and air lead to differing phase velocities between the fields that result in poorer coupler directivity and narrower bandwidth. The square teeth in the Culling device are intended to compensate for this difference in phase velocity by equalizing the propagation delays of each mode. The wave associated with the even mode impedance is caused to meander around the gap created by the teeth. The increase in effective path length is sufficient to correct for the difference in effective velocity.

Practical limits exist, however, on the number and size of the teeth that may be used to delay the propagation of the faster wave. As a result, the Culling device cannot correct for the effects of dielectrics with very high coefficients of permittivity. It would be desirable to provide a system capable of equalizing the phase velocities regardless of the permittivity of the material.

SUMMARY OF THE INVENTION

In accordance with one aspect of the present invention, a directional coupler comprises a coupler circuit board which is mounted substantially perpendicular to the surface of a parent circuit board. First and second upper traces are disposed on the opposing surfaces of the coupler circuit board. The coupling between the upper electrically conductive traces determines the odd mode impedance of the coupler. First and second lower traces are also disposed on opposing surfaces and connected to ground. The upper and lower traces are arranged such that the even mode impedance is determined by the coupling between the first upper trace and the second lower trace and the coupling between the second upper trace and the first lower trace.

In accordance with another aspect of the invention, a directional coupler comprises a coupler circuit board which is mounted substantially perpendicular to the surface of a parent circuit board. First and second electrically conductive traces are disposed on the opposing surfaces of the coupler circuit board. The first upper electrically conductive trace has a straight top edge and a bottom edge with a number of teeth disposed thereon. The second upper electrically conductive trace also has a straight top edge and a bottom edge with a plurality of teeth disposed thereon and offset from the teeth on the first upper trace. The upper electrically conductive traces are electrically coupled to cause the coupler to exhibit an odd mode impedance, determined by the width of the traces. This impedance is a function of the required coupling factor and characteristic impedance of the coupler.

First and second lower electrically conductive traces are also disposed on the opposing surfaces of the coupler circuit board. Each of said lower electrically conductive traces are spaced from its respective upper trace. The first lower trace has a straight bottom edge and a top edge with a number of teeth staggered relative to the teeth on the bottom edge of the first upper trace. The teeth are laterally registered against the teeth on the second upper trace, such that the area covered by the teeth of the first lower trace partially overlaps an area representing the position of the teeth of the second upper trace projected onto the surface of the coupler circuit board containing the first lower trace. The second lower trace also has a straight bottom edge and a top edge with a number of teeth staggered relative to the teeth disposed on the bottom edge of the second upper trace. The teeth are laterally registered against teeth of the first upper trace, such that the area covered by the teeth of the second lower trace partially overlaps an area representing the position of the teeth of the first upper trace projected onto the surface of the coupler circuit board containing the second lower trace.

The first upper trace is electrically coupled to the second lower trace and the second upper trace is electrically coupled to the first lower trace. This causes the coupler to exhibit an even mode impedance, determined by the overlapping area of the teeth. The value of the impedance varies as a function of the required coupling factor and characteristic impedance of the coupler.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF THE PREFERRED EMBODIMENT

Figure 1:
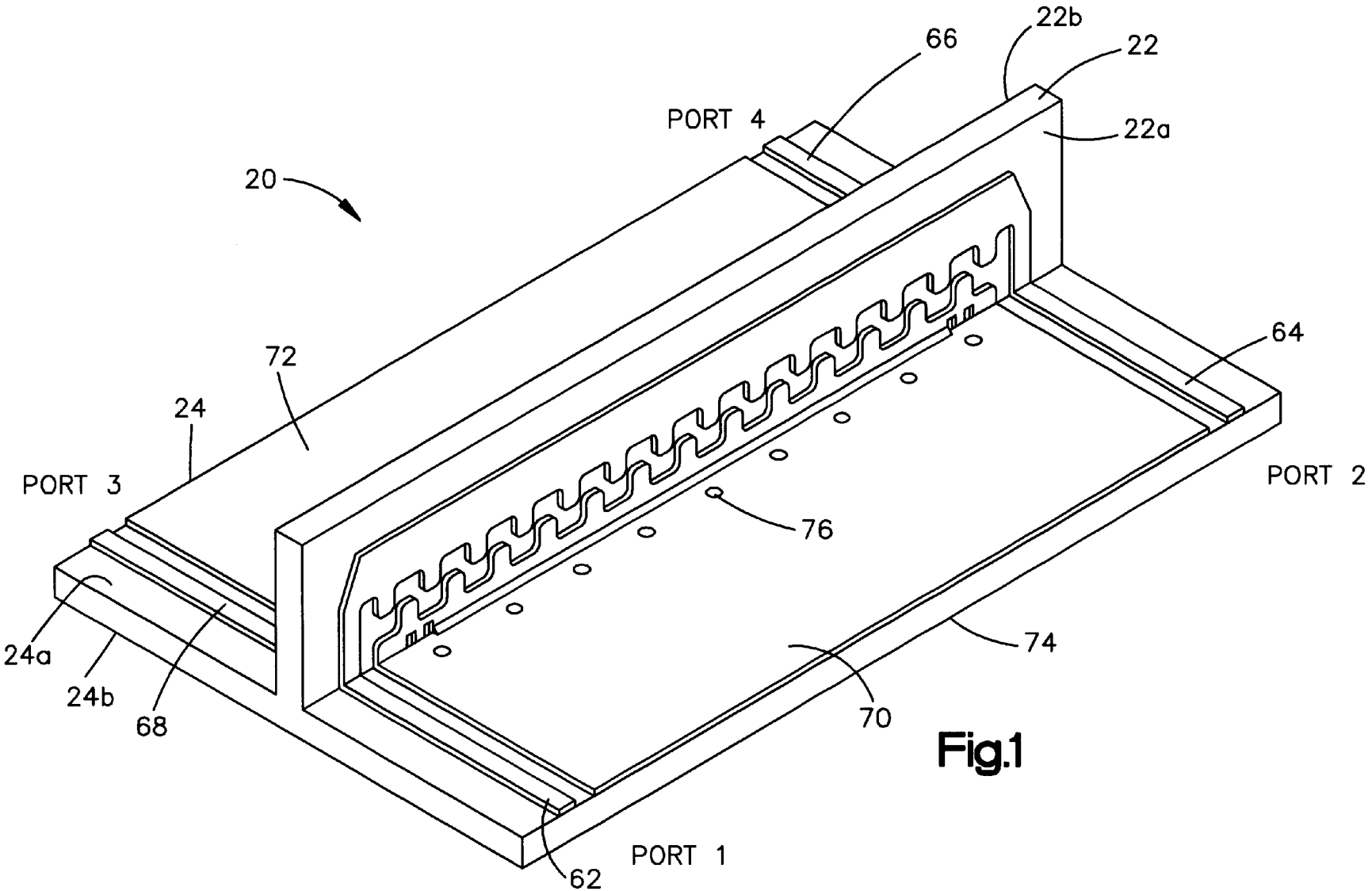
FIG. 1 is a directional coupler in accordance with the present invention.
Figure 2:
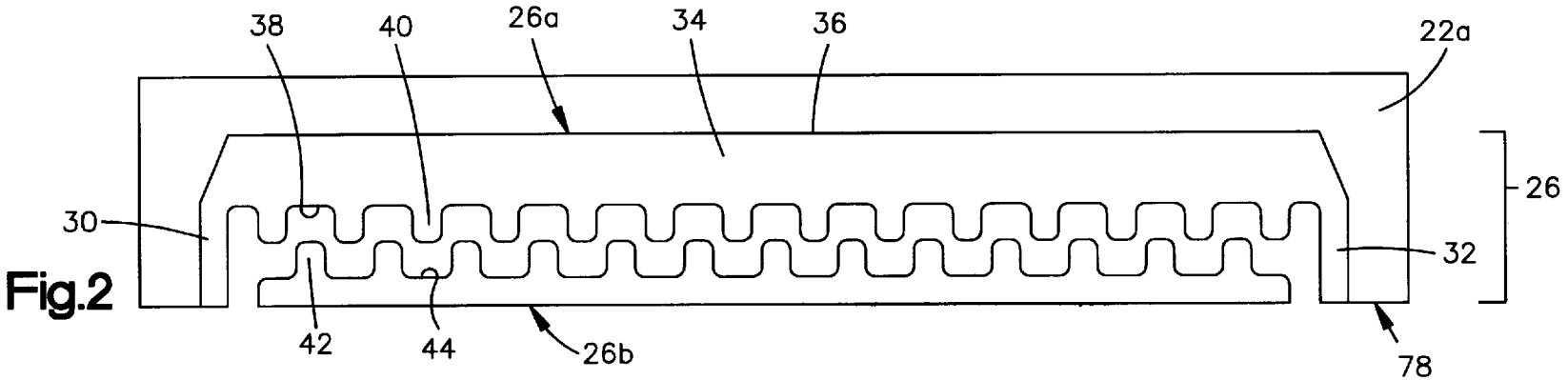
FIG. 2 is a side view of the first surface of the coupler PCB.
Figure 3:
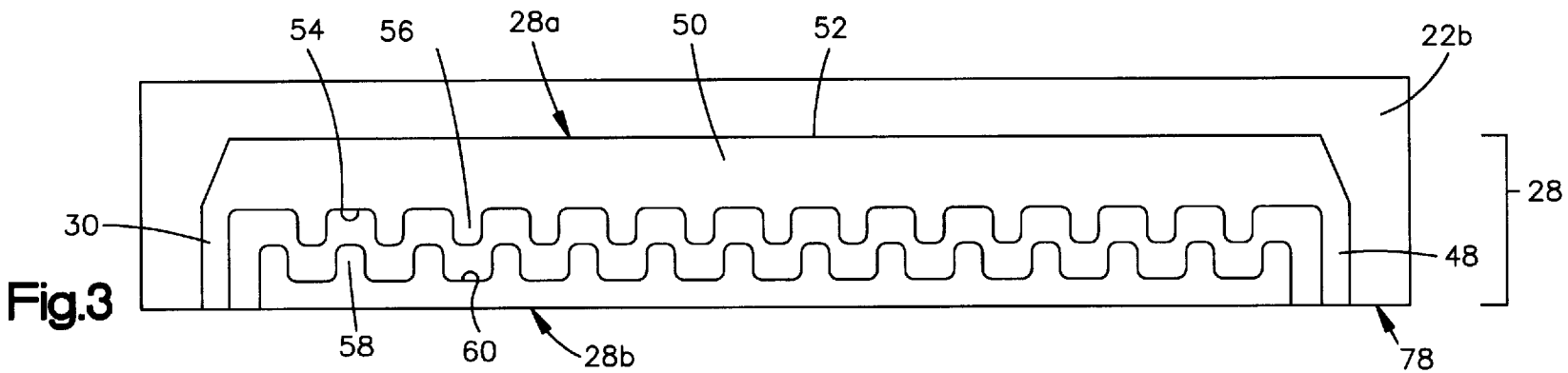
FIG. 3 is a side view of the second surface of the coupler PCB.

A directional coupler 20 in accordance with the present invention is shown in FIGS. 1–5. The coupler 20 includes a coupler circuit board 22 having planar surfaces 22*a* and 22*b*. In the illustrated embodiment, the coupler circuit board 22 is a printed circuit board (PCB). Printed circuit boards are well-known in the art, and the coupler circuit board 22 can be fashioned by any suitable method. The coupler 20 is mounted on a parent circuit board 24 having planar surfaces 24*a* and 24*b*. The coupler 20 is mounted with its planar surfaces 22*a* and 22*b* normal to the planar surfaces 24*a* and 24*b* of the parent circuit board 24. Although not shown in FIGS. 1–5, other peripheral circuitry associated with the circuit in which the coupler 20 is being used is also mounted on the parent circuit board 24.

The coupler 20 includes first and second interdigitated coupling elements 26 and 28 disposed on surfaces 22*a* and 22*b*, respectively. The first interdigitated coupling element 26 includes a first upper trace 26*a* and a first lower trace 26*b*. The first upper trace 26*a* comprises two side sections 30 and 32, each connected to one end of a longitudinal section 34 having a predetermined length and width. The longitudinal section 34 has a straight upper edge 36 and a lower edge 38 having teeth 40. Interdigitated with the teeth 40 in a staggered pattern are teeth 42 formed on an upper edge 44 of the first lower trace 26*b*.

The second interdigitated coupling element 28 is disposed opposite the first interdigitated coupling element 26 on the planar surface 22*b*. The second interdigitated coupling element 28 includes a second upper trace 28*a* and a second lower trace 28*b*. The second upper trace 28*a* comprises two side sections 46 and 48, each connected to one end of a longitudinal section 50 having a predetermined length and width. The longitudinal section 50 has a straight upper edge 52 and a lower edge 54 having teeth 56. Interdigitated with the teeth 56 in a staggered pattern are teeth 58 formed on the upper edge 60 of the second lower trace 28*b*.

Figure 4:
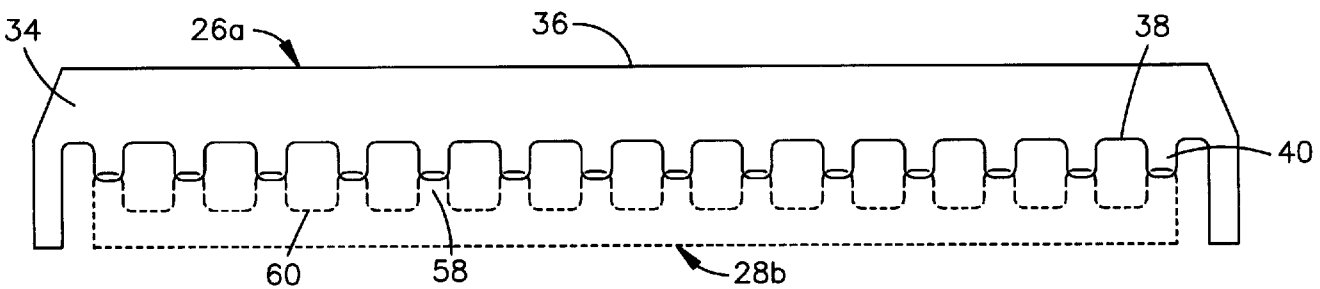
FIG. 4 is a side view showing the first upper trace in relation to a projection of the position of the second lower trace onto the first surface of the coupler.

As shown in FIG. 4, the first and second interdigitated coupling elements 26 and 28 are not symmetrical across a plane through the center of the coupler PCB 22. The position of the upper edge 36 of the longitudinal section 34 of the first upper trace 26*a* coincides with the position of the upper edge 52 of the longitudinal section 50 of the second upper trace 28*a* on the opposite side of the coupler PCB 22. The teeth 40 formed on the lower edge 38 of the first upper trace 26*a*, however, are offset from the teeth 56 formed on the lower edge 54 of the second trace 28*a*. Accordingly, the teeth 42 formed on the upper edge 44 of the first lower trace 26*b* are offset from the teeth 58 formed on the upper edge 60 of the second lower trace 28*b*. Consequently, the upper traces 26*a* and 28*a* remain interdigitated with their respective lower trace 26*b* or 28*b*, but the lower trace 26*b* and 28*b* are positioned such that their teeth 42 and 58 overlap a projection of the position of the teeth 40 or 56 of the upper trace 26*a* or 28*a* onto the opposing side of the PCB 22. This overlap is illustrated by the dotted line in FIG. 4.

There are also conductive traces that must be disposed on the parent circuit board to facilitate the mounting of the coupler 20. On the planar surface 24*a* of the parent circuit board 24 are disposed four conductive traces 62, 64, 66, 68. The traces 62, 64, 66, 68 provide direct connection to the side sections 30, 32, 46, and 48 of the upper traces 26*a* and 26*b* respectively, with minimal end effects. This provides good impedance matching between a conductive trace and its associated side section. In addition to the conductive traces 62, 64, 66, and 68, two ground planes 70 and 72 are also disposed on the planar surface 24*a* of the parent circuit board 24. The ground planes are made the same width as the lower traces 26*b* and 28*b*. A lower ground plane 74 is disposed on the planar surface 24*b* of the parent circuit board 24. Each ground plane 70 and 72 is connected to this lower ground plane 74 by a plurality of vias 76. The lower ground plane 74 is connected to system ground potential, and the vias 76 result in the ground planes 70 and 72 also being at system ground potential.

The directional coupler 20 is connected to the parent circuit board 24 by soldering the conductor traces disposed on the coupler PCB 22 to those disposed on the parent circuit board. The side sections 30 and 32 are soldered at the lower edge 78 of the coupler PCB 22 to the conductive traces 62 and 64 respectively. The side sections 46 and 48 are likewise soldered at lower edge 78 to the conductive traces 66 and 68 respectively. The first lower trace 26*b* is soldered at the lower edge 78 to the ground plane 70 while the second lower trace 28*b* is soldered at the lower edge 78 to the ground plane 72. All these solder connections form fillet solder joints 80. Other methods such as a suitable conductive adhesive may be used in place of fillet solder joints 80.

Proper mechanical alignment of the coupler PCB 22 during soldering or other means of connection can be accomplished by the use of mounting pegs (not shown). Each of the mounting pegs fits into an associated mounting hole (not shown) on the parent circuit board 24. The use of mounting pegs for alignment, and the use of fillet solder joints 80 for mechanical and electrical connection can be easily automated using known "pick-and-place" assembly techniques.

The electrical characteristics of the directional coupler 20 are determined by the coupling factor C of the coupler.

When currents of equal magnitude are flowing in the same direction in both the upper traces 26*a* and 28*a*, an even mode impedance designated $Z_{oo}$ exists between each element and ground. Similarly, when currents of equal magnitude but opposite direction are flowing in the upper traces 26*a* and 28*a*, an odd mode impedance designated $Z_{oo}$ exists between each element and ground. The even and odd mode impedances for a coupled pair of lines are given by the equations:

$$Z_{oo} = Z_o\sqrt{\frac{1-C}{1+C}} \tag{1}$$

$$Z_{oe} = Z_o\sqrt{\frac{1+C}{1-C}} \tag{2}$$

where C is the coupling factor and $Z_o$ is the characteristic impedance of the transmission line to which the coupler 20 is connected (i.e. conductive traces 62–68). Equations (1) and (2) show the functional relationship between the coupling factor C and the even and odd mode impedances $Z_{oe}$ and $Z_{oo}$ required to achieve that coupling factor.

Equations (1) and (2) assume that the phase velocities of the waves associated with both the even and odd mode impedances $Z_{oe}$ and $Z_{oo}$ are equal. This cannot always be assumed, as the material through which a wave passes has a significant effect on its phase velocity. The general equation for phase velocity is:

$$V_P = c/\sqrt{\epsilon_{eff}} \tag{3}$$

where c is the speed of light in free space (i.e. $3\times10^8$ meter/sec.) and $\epsilon_{eff}$ is the effective permittivity of the medium in which the electric field is propagating.

Figure 7:
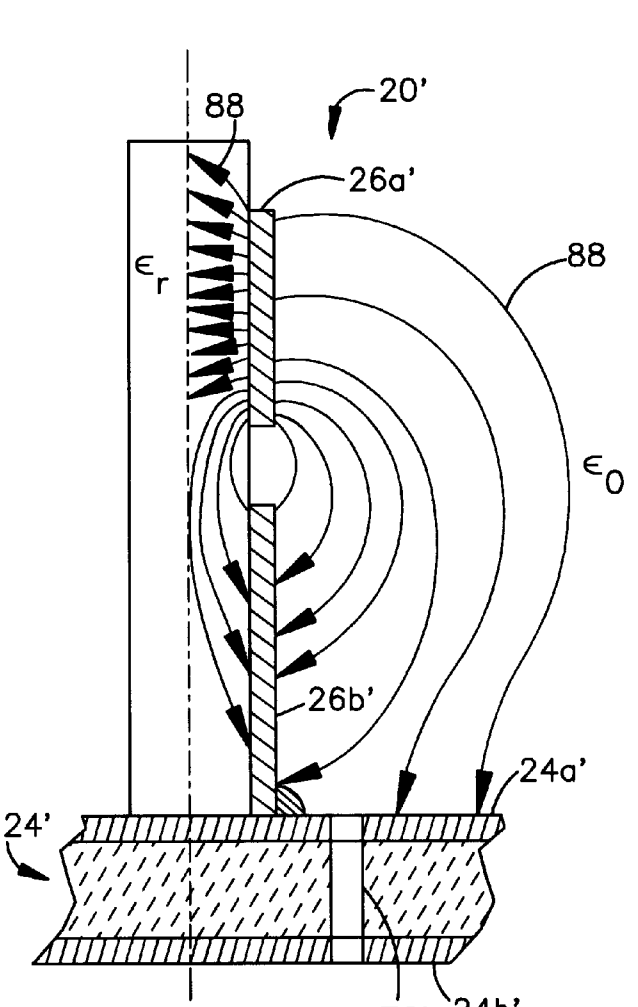
Fig.7 PRIOR ART
FIG. 7 is a cross-sectional view of a prior art directional coupler showing the electric field associated with the even mode impedance $Z_{oe}$.
Figure 6:
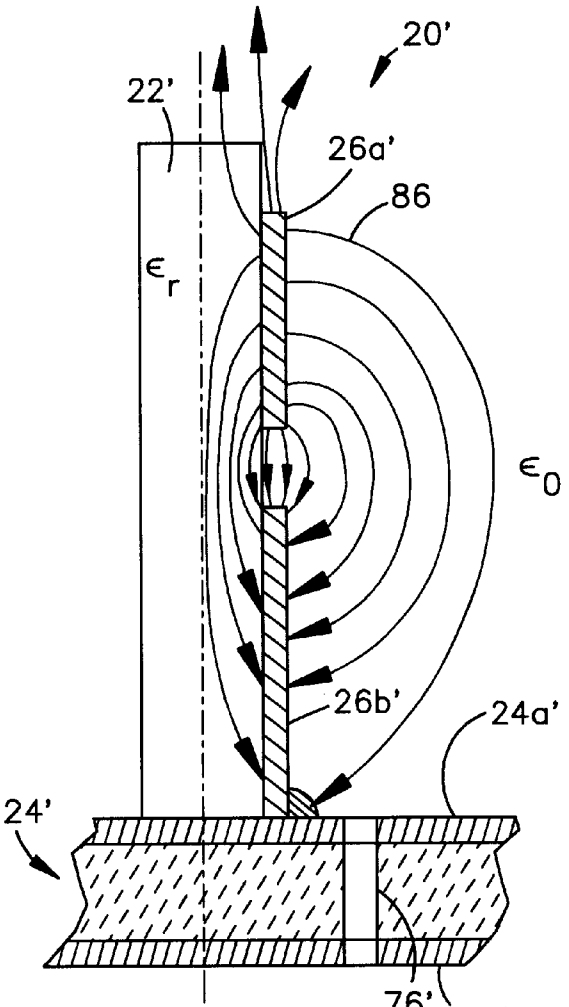
Fig.6 PRIOR ART
FIG. 6 is a cross-sectional view of a prior art directional coupler showing the electric field associated with the even mode impedance $Z_{oo}$.

FIGS. 6 and 7 illustrate the propagation of the electric fields (86 and 88) associated with the even and odd mode impedances in a prior art device. An electric field is generally strongest along the shortest path to ground, as the force on a charged particle is strongest over the largest change in potential per unit distance. In the device 20' shown, the shortest path to ground for the electric field 86 associated with the even mode impedance (FIG. 6), lies between the upper (i.e. 26*a*') and lower (i.e. 26*b*') traces on one side of the device. Accordingly, the electric field propagates partially in the coupler board 22' and partially in air. Thus, the effective permittivity $\epsilon_{eff}$ experienced by the field falls somewhere between $\epsilon_r$ and the permittivity of air, $\epsilon_0$. The electric field 88 associated with the odd mode impedance (FIG. 7) likewise is strongest between the two upper traces 26*a*' and 26*b*'. Thus, the electric field propagates primarily in the coupler board 22' and experiences an effective permittivity $\epsilon_{eff}$ close to that of the relative permittivity $\epsilon_r$ of the coupler board. This value is significantly different from the permittivity experienced by the field associated with the even mode impedance.

When these phase velocities of the two fields are not equal, it is necessary to correct for the difference. Otherwise, the bandwidth and directivity of the directional coupler are adversely affected. This has been accomplished in the prior art by forcing the wave with the higher phase velocity to travel a convoluted path, causing it to travel a larger effective distance. Consequently, the propagation of both waves is delayed equally. This method does not function well when the coupler board 22' is constructed from a material with a large permittivity. Unfortunately, many of the common, inexpensive materials used to construct printed circuit boards have permittivity values too large to be corrected for without a significant loss in performance. As a result, more expensive materials must be used.

Figure 8:
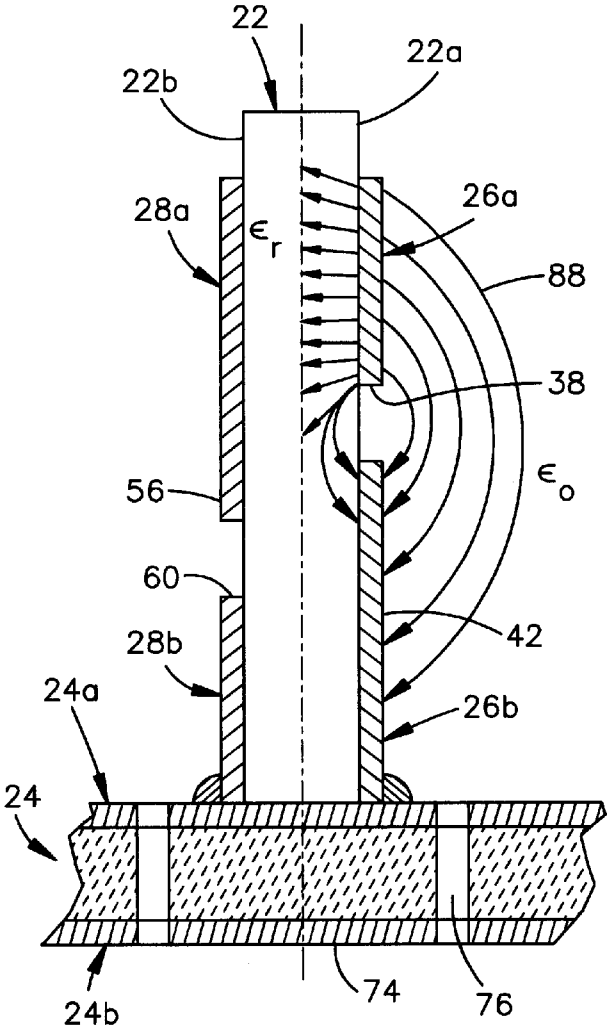
FIG. 8 is a cross-sectional view of a directional coupler in accordance with the present invention showing the electric field associated with the odd mode impedance $Z_{oe}$ at a point where a tooth from the first upper trace overlaps a tooth disposed on the second lower trace.
Figure 5:
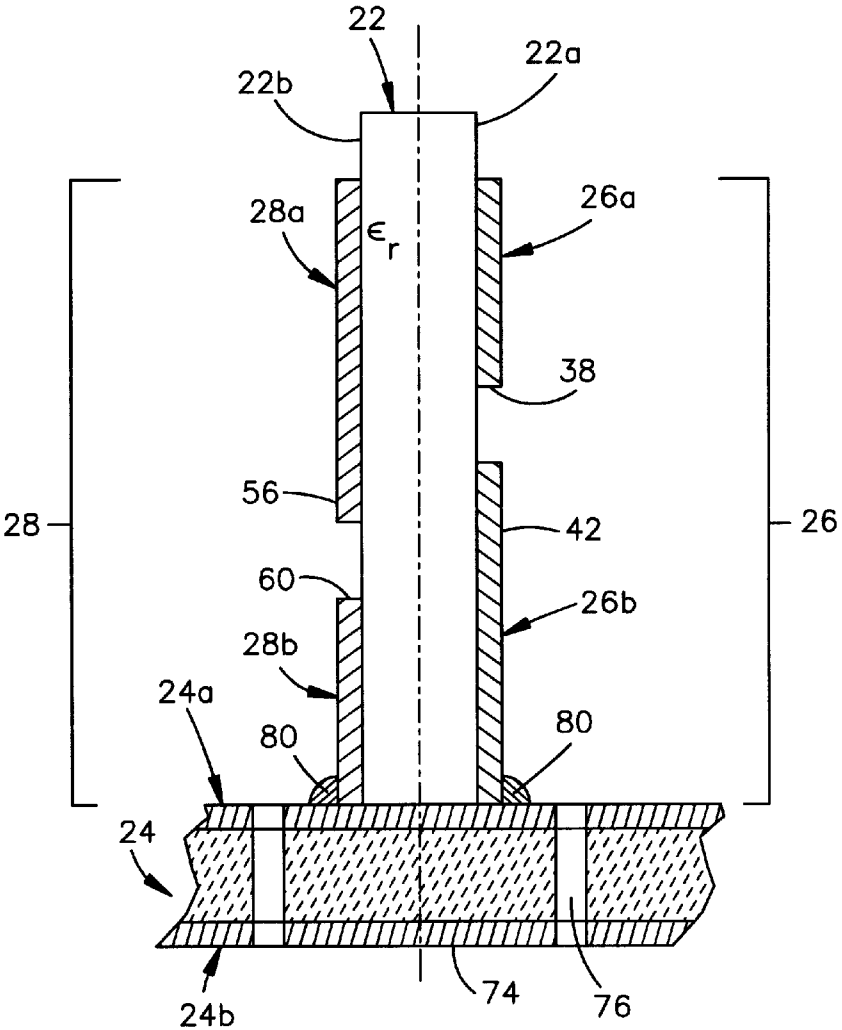
FIG. 5 is a cross-sectional view of a directional coupler in accordance with the present invention at a point where a tooth from the first upper trace overlaps a tooth disposed on the second lower trace.
Figure 10:
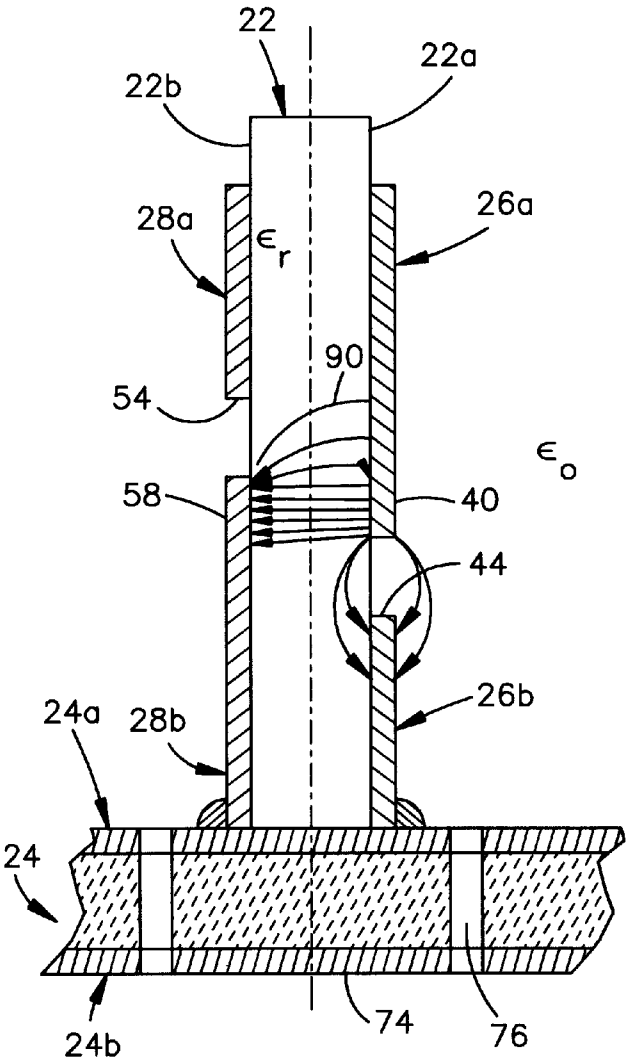
FIG. 10 is a cross-sectional view of a directional coupler in accordance with the present invention showing the electric field associated with the even mode impedance $Z_{oe}$ at a point where a tooth from the second upper trace overlaps a tooth disposed on the first lower trace.
Figure 9:
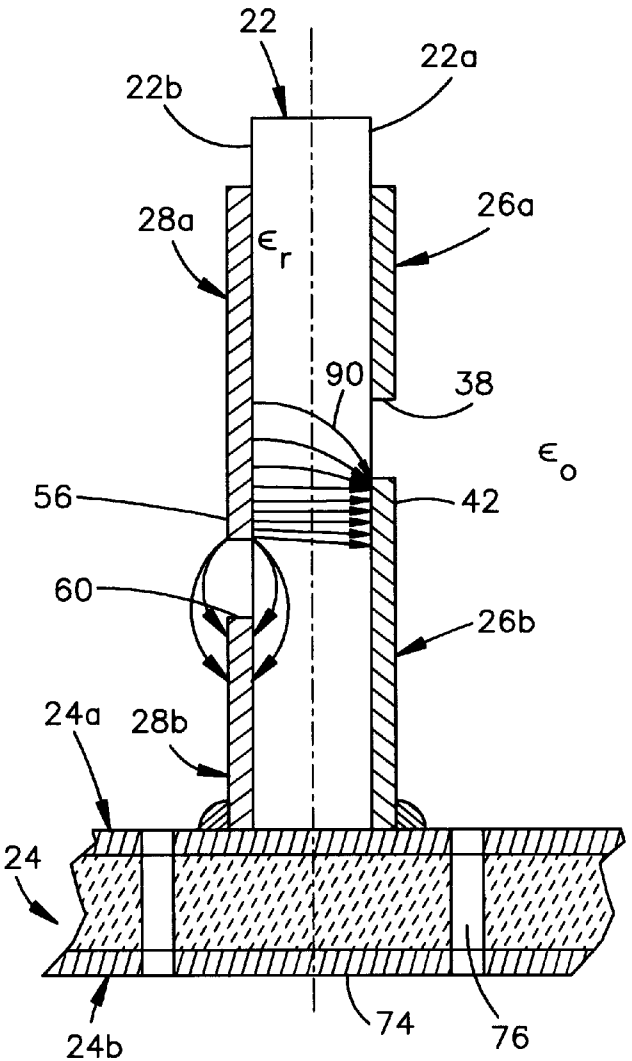
FIG. 9 is a cross-sectional view of a directional coupler in accordance with the present invention showing the electric field associated with the even mode impedance $Z_{oe}$ at a point where a tooth from the first upper trace overlaps a tooth disposed on the second lower trace.

The present invention corrects the differing phase velocities by adjusting the propagation of the electric field 86 associated with the even mode to pass to ground through the PCB 22. As shown in FIGS. 8–10, the teeth on one surface of the PCB (i.e. 40 and 42) are offset in relation to the teeth on the other surface (i.e. 56 and 58) such that the lower teeth on each side are positioned to overlap the upper teeth on the other side. It is to be noted here that the thickness of the PCB 22 is generally less than the distance between the spacing between the upper and lower traces (i.e. 26*a* and 26*b*) on each side. Accordingly, the shortest distance to ground for the electric field 90 associated with the even mode is a path from the upper teeth (i.e. 40) through the PCB 22 to the lower teeth on the other side (i.e. 58). The electric field 90 associated with the even mode impedance thus experiences a permittivity similar to that experienced by the electric field 88 associated with the odd mode impedance. Consequently, the phase velocities of the two fields 88 and 90 are substantially equal, regardless of the permittivity of the material used to construct the coupler PCB 22.

It should be noted that the length, width, and tooth size of the upper electrically conductive traces 26*a* and 28*a* and the lower electrically conductive traces 26*b* and 28*b* are variable according to the desired characteristics of the coupler. For example, the widths of the upper electrically conductive traces 26*a* and 28*a* can be altered. An alteration in these widths alters the characteristics of the coupling between the two upper traces 26*a* and 28*a* and accordingly, changes the odd mode impedance of the coupler 20. Similarly, the size and shape of the teeth 40, 42, 56, and 58 on the upper traces 26*a* and 28*a* and the lower traces 26*b* and 28*b* can be altered to increase or decrease the overlap between the teeth on opposite sides of the coupler PCB 22. A change in the area of overlap affects the coupling of the upper traces 26*a* and 28*a* to the opposing lower traces 26*b* and 28*b* and thus affects the even mode impedance of the coupler 20. Such a change in either the even or odd mode impedance of the coupler alters the coupling factor of the coupler. The lengths of the upper traces 26*a* and 26*b* and the lower traces 26*b* and 28*b* can also be adjusted. These lengths are scaled as a function of the desired operating frequency of the coupler 20.

From the above description of the invention, those skilled in the art will perceive improvements, changes, and modifications. Such improvements, changes, and modifications within the skill of the art are intended to be covered by the appended claims.

Having described the invention, we claim the following:

1. A broadside directional coupler, comprising:

a parent circuit board having opposing conductive surfaces;

a coupler circuit board formed from a substrate material, having opposing surfaces, and mounted on said parent circuit board with the opposing surfaces thereof substantially perpendicular to one of the opposing surfaces of said patent circuit board;

first and second upper electrically conductive traces respectively disposed on the opposing surfaces of said coupler circuit board, said upper electrically conductive traces being electrically coupled together through said coupler circuit board substrate material to cause said coupler to exhibit an odd mode impedance, determined by the width of the traces and varying as a function of a required coupling factor and a characteristic impedance of the coupler; and first and second lower electrically conductive traces respectively disposed on the opposing surfaces of said coupler circuit board, each of said lower electrically conductive traces being spaced from the respective upper electrically conductive traces, said first upper electrically conductive trace being electrically coupled to said second lower electrically conductive trace through said coupler circuit board substrate material and said second upper electrically conductive trace being electrically coupled to said first lower trace through said coupler circuit board substrate material to cause said coupler to exhibit an even mode impedance.

2. A directional coupler as recited in claim 1 wherein said coupler circuit board has a relative permittivity equal to that of the parent circuit board.

3. A directional coupler as recited in claim 1, having a desired operating frequency and wherein said first and second upper and lower electrically conductive traces have lengths that are scaled as a function of the desired operating frequency.

4. A directional coupler as recited in claim 1 wherein said first and second lower electrically conductive traces are electrically connected to a system ground potential.

5. A directional coupler as recited in claim 1 wherein the spacing between said upper electrically conductive traces and their respective lower electrically conductive traces is of greater distance than the distance between the opposing surfaces of said coupler circuit board.

6. A directional coupler as recited in claim 1, wherein said coupler circuit board is a printed circuit board.

7. A broadside directional coupler, comprising:

a parent circuit board having opposing conductive surfaces;

a coupler circuit board having opposing surfaces and mounted on said parent circuit board with the opposing surfaces thereof substantially perpendicular to one of the opposing surfaces of said parent circuit board;

first and second electrically conductive traces respectively disposed on the opposing surfaces of said coupler circuit board, said first upper electrically conductive trace having a straight top edge and a bottom edge having a plurality of teeth disposed thereon and said second upper electrically conductive trace having a straight top edge and a bottom edge with a plurality of teeth disposed thereon, offset from the teeth disposed on said first upper electrically conductive trace, said upper electrically conductive traces being electrically coupled to cause said coupler to exhibit an odd mode impedance, determined by the width of the traces and varying as a function of a required coupling factor and a characteristic impedance of the coupler; and first and second lower electrically conductive traces respectively disposed on the opposing surfaces of said coupler circuit board, each of said lower electrically conductive traces being spaced from the respective upper trace, said first lower electrically conducting trace having a straight bottom edge and a top edge having a plurality of teeth disposed thereon with the teeth staggered relative to the teeth disposed on the bottom edge of said first upper electrically conductive trace and laterally registered against teeth of said second upper trace, such that the area covered by the teeth of said first upper trace partially overlaps an area representing the position of the teeth of said second lower trace projected onto the first surface of said coupler circuit board, and said second lower electrically conducting trace having a straight bottom edge and a top edge having a plurality of teeth disposed thereon with the teeth staggered relative to the teeth disposed on the bottom edge of said second upper trace and laterally registered against teeth of said first upper trace, such that the area covered by the teeth of said second upper trace partially overlaps an area representing the position of the teeth of said first lower trace projected onto the second surface of said coupler circuit board, said first upper electrically conductive trace being electrically coupled to said second lower electrically conductive trace and said second upper electrically conductive trace being electrically coupled to said first lower trace to cause said coupler to exhibit an even mode impedance, determined by the overlapping area of their teeth and having a value that varies as a function of the required coupling coefficient and characteristic impedance of the coupler.

8. A directional coupler as recited in claim 7 wherein said coupler circuit board has a relative permittivity equal to that of the parent circuit board.

9. A directional coupler as recited in claim 7, having a desired operating frequency and wherein said first and second upper and lower electrically conductive traces have lengths that are scaled as a function of the desired operating frequency.

10. A directional coupler as recited in claim 7 wherein said first and second lower electrically conductive traces are electrically connected to a system ground potential.

11. A directional coupler as recited in claim 7 wherein the spacing between said upper electrically conductive traces and their respective lower electrically conductive trace is of greater distance than the distance between the opposing surfaces of said coupler circuit board.

12. A directional coupler as recited in claim 7, wherein said coupler circuit board is a printed circuit board.

13. A broadside directional coupler, comprising:

a parent circuit board having opposing conductive surfaces;

a coupler circuit board having opposing surfaces and mounted on said parent circuit board with the opposing surfaces thereof substantially perpendicular to one of the opposing surfaces of said parent circuit board;

first and second electrically conductive traces respectively disposed on the opposing surfaces of said coupler circuit board, said first upper electrically conductive trace having a straight top edge and a bottom edge having a plurality of teeth disposed thereon and said second upper electrically conductive trace having a straight top edge and a bottom edge with a plurality of teeth disposed thereon, offset from the teeth disposed on said first upper electrically conductive trace, said upper electrically conductive traces being electrically coupled to cause said coupler to exhibit an odd mode impedance, determined by the width of the traces and varying as a function of a required coupling factor and a characteristic impedance of the coupler; and first and second lower electrically conductive traces respectively disposed on the opposing surfaces of said coupler circuit board, each of said lower electrically conductive traces being spaced from the respective upper trace, said first lower electrically conducting trace having a straight bottom edge and a top edge having a plurality of teeth disposed thereon with the teeth staggered relative to the teeth disposed on the bottom edge of said first upper electrically conductive trace and laterally registered against teeth of said second upper trace, such that the area covered by the teeth of said first upper trace partially overlaps an area representing the position of the teeth of said second lower trace projected onto the first surface of said coupler circuit board, and said second lower electrically conducting trace having a straight bottom edge and a top edge having a plurality of teeth disposed thereon with the teeth staggered relative to the teeth disposed on the bottom edge of said second upper trace and laterally registered against teeth of said first upper trace, such that the area covered by the teeth of said second upper trace partially overlaps an area representing the position of the teeth of said first lower trace projected onto the second surface of said coupler circuit board, said first upper electrically conductive trace being electrically coupled to said second lower electrically conductive trace and said second upper electrically conductive trace being electrically coupled to said first lower trace to cause said coupler to exhibit an even mode impedance, determined by the overlapping area of their teeth and having a value that varies as a function of the required coupling coefficient and characteristic impedance of the coupler;

characterized in that an equal number of teeth are disposed on said first upper trace and said second lower trace, an equal number of teeth are disposed on said second upper trace and said first lower trace, and the number of teeth disposed on said first upper trace is greater than the number of teeth disposed on said second upper trace.

* * * * *